US010537197B2

(12) United States Patent
Hopp

(10) Patent No.: US 10,537,197 B2
(45) Date of Patent: Jan. 21, 2020

(54) EXPANDABLE, LOCKING BAG TO PREVENT DELIVERED PACKAGES FROM BEING STOLEN

(71) Applicant: Jeffrey B. Hopp, Arlington, VA (US)

(72) Inventor: Jeffrey B. Hopp, Arlington, VA (US)

( * ) Notice: Subject to any disclaimer, the term of this patent is extended or adjusted under 35 U.S.C. 154(b) by 0 days.

(21) Appl. No.: 16/245,941

(22) Filed: Jan. 11, 2019

(65) Prior Publication Data

US 2019/0223644 A1 Jul. 25, 2019

Related U.S. Application Data

(60) Provisional application No. 62/619,304, filed on Jan. 19, 2018.

(51) Int. Cl.

| | |
|---|---|
| ***A47G 29/20*** | (2006.01) |
| *A47G 29/18* | (2006.01) |
| *A47G 29/16* | (2006.01) |
| *B65D 55/14* | (2006.01) |

(52) U.S. Cl.

CPC ..... *A47G 29/20* (2013.01); *A47G 29/16* (2013.01); *A47G 29/18* (2013.01); *B65D 55/14* (2013.01)

(58) Field of Classification Search

CPC ..... A47G 29/20; A47G 29/16; A47G 29/18; A47G 29/1216; A47G 29/124; A47G 29/24; A47G 2029/144; A47G 2029/148; B65D 55/14

USPC ..... 232/19, 17, 45, 39; 383/63, 66

See application file for complete search history.

(56) References Cited

U.S. PATENT DOCUMENTS

| | | | | |
|---|---|---|---|---|
| 6,155,715 | A * | 12/2000 | Lake | A47G 29/20 150/102 |
| 9,364,112 | B2 * | 6/2016 | Sundaresan | A47G 29/124 |
| 9,596,952 | B2 * | 3/2017 | Mencel | A47G 29/20 |
| 10,083,561 | B2 * | 9/2018 | Sundaresan | E05B 73/0011 |
| 10,143,321 | B2 * | 12/2018 | Hippert | A47G 29/20 |
| 10,329,804 | B2 * | 6/2019 | Evans | E05B 73/0005 |
| 2012/0269461 | A1 * | 10/2012 | Proctor | A47G 29/20 383/64 |
| 2013/0077896 | A1 * | 3/2013 | Wiley | B65D 33/00 383/86.2 |
| 2015/0305538 | A1 * | 10/2015 | Sundaresan | A47G 29/124 232/36 |
| 2016/0068306 | A1 * | 3/2016 | Heinz | B65D 21/086 220/560.01 |
| 2017/0055751 | A1 * | 3/2017 | Sundaresan | E05B 73/0011 |
| 2018/0162612 | A1 * | 6/2018 | Bojic | B65D 55/14 |
| 2018/0202199 | A1 * | 7/2018 | Critz | A47G 29/141 |
| 2018/0228311 | A1 * | 8/2018 | Bloom | A47G 29/141 |
| 2019/0104876 | A1 * | 4/2019 | Loures | A47G 29/20 |
| 2019/0133362 | A1 * | 5/2019 | Gilligan | A47G 29/20 |

* cited by examiner

*Primary Examiner* — William L Miller

(57) ABSTRACT

This invention is new because it's the first device of its kind designed to be used to prevent packages from being stolen after delivery to a consumer's house. Other methods like locking boxes or special locks either already exist, or are being developed but this device is the first locking bag for that purpose that is held securely by an extended strap that closes under a door, or secures to a physical object.

3 Claims, 1 Drawing Sheet

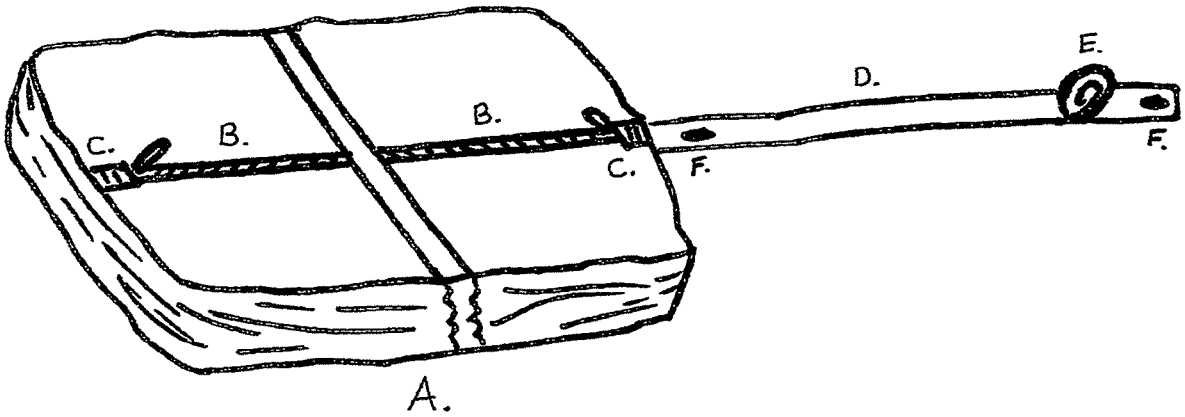
E.
D.
B.
B.
C.
C.
F.
F.
A.

EXPANDABLE, LOCKING BAG TO PREVENT DELIVERED PACKAGES FROM BEING STOLEN

CROSS REFERENCE TO RELATED APPLICATIONS

Provisional Patent Application No. 62/619,304 dated Jan. 19, 2018.

STATEMENT REGARDING FEDERALLY SPONSORED RESEARCH OR DEVELOPMENT

Not Applicable.

NAMES OF PARTIES TO A JOINT RESEARCH AGREEMENT

Not Applicable.

REFERENCE TO A SEQUENCE LISTING

Not Applicable.

STATEMENT REGARDING PRIOR DISCLOSURES BY THE INVENTOR OR A JOINT INVENTOR

Not Applicable.

BACKGROUND OF THE INVENTION

Each year millions of packages are delivered by Amazon, UPS, FedEx, USPS and others to homes across the United States. E-commerce and home delivery of goods is growing at a rapid rate, but theft of packages is also growing at a rapid rate.

This invention of an expandable, locking pouch or bag (device) that secures to the homeowner's house aims to reduce the number of stolen packages.

SUMMARY OF THE INVENTION

The general idea of this invention was to develop a device that could help solve the growing problem of packages from being stolen from peoples houses after they are delivered.

Commonly these people that steal packages are referred to as "Porch Pirates." The advantages of using this invention are many. Among them, it will prevent Porch Pirates from being able to grab and run off with your packages and it is easily deployed when you are expecting a delivery, yet stores easily when not in use. The materials are cut and tear resistant. The tail strap is cut proof.

BRIEF DESCRIPTION OF THE DRAWINGS

FIG. 1 shows the locking pouch.

DETAILED DESCRIPTION OF THE INVENTION

This invention would be used as follows: when a consumer orders a product online and arranges for it to be delivered to their house (for example), they would set this locking, expandable bag on their porch (for example). They would be sure the locking zipper(s) are unlocked, run the tail strap under their door and close the door on the strap. A rolled-up amount of fabric sewn into the strap would prevent the strap from being pulled out under the door. A removable pin would also achieve this result. The delivery person would bring the package to the house, they would place the package inside the bag and zip it closed. The zipper would self-lock when closed, or be locked with another mechanical or electronic device. When the recipient returns home, they unlock the bag, remove their package and store the bag for future use. It's made from cut and tear resistant fabric and the strap that closes under the door is designed to be cut proof.

FIG. 1 shows a rendering of what the final product would resemble. It shows the bag/pouch (A), two zippers (B) to close and secure two respective chambers, it shows the location of cooperating locking mechanisms (C) and it shows the tail strap (D) that closes under the user's door to secure it from being stolen. It also shows the expected position of rolled fabric (E) to keep it from being pulled out from under the door. The alternative method of securing the device to a house or other physical object is grommet holes (F) along the tail strap and a cooperating lock (not shown).

The bag is made of sturdy, expandable fabric. The delivery person places the package inside the bag, zips it closed, and locks it via the locking mechanism. The tail strap closes under the homeowner's door and the rolled fabric prevents the bag from being removed (i.e. pulled out from under the door) by a thief. The tail strap is made of a cut resistant fabric and, as an alternative to being closed under the house door, can be wrapped around a house or physical object, such as porch railing, and secured through the grommets with the lock. The bag is not limited to one or two chambers, but could contain multiple chambers for multiple packages to be placed inside. The bag would be produced in various sizes.

The invention claimed is:

1. An expandable locking pouch configured to be secured to a house or physical object for securely maintaining parcels or packages after delivery, the pouch comprising:

a main body formed of an expandable fabric and including a plurality of chambers configured to separately accommodate the parcels or packages therein;

a respective zipper and cooperating locking mechanism for each chamber;

a tail strap formed of cut resistant fabric, the tail strap having a first end attached to the main body and an opposing second free end, the tail strap including at least one grommet hole adjacent each end of the tail strap, and a rolled fabric portion adjacent the second free end of the tail strap; and wherein the tail strap is configured to be positioned under a door of the house such that the main body is positioned at a front side of the door and the rolled fabric portion is positioned at the opposite rear side of the door when the door is closed, the rolled fabric portion being sized and configured for abutting the rear side of the door thereby preventing the pouch from being removed from the closed door.

2. The pouch of claim 1, wherein the locking mechanism is a mechanical lock.

3. The pouch of claim 1, wherein the locking mechanism is an electronic lock.

* * * * *